US011453225B2

(12) United States Patent
Cavallini et al.

(10) Patent No.: US 11,453,225 B2
(45) Date of Patent: Sep. 27, 2022

(54) DEVICES AND SYSTEMS FOR LOCATING AND PRINTING ON GLASS SUPPORTS

(71) Applicant: SYSTEM CERAMICS S.P.A., Fiorano Modenese (IT)

(72) Inventors: Federico Cavallini, Modena (IT); Giuliano Pistoni, Baiso (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 4 days.

(21) Appl. No.: 17/285,079

(22) PCT Filed: Oct. 17, 2019

(86) PCT No.: PCT/IB2019/058845
§ 371 (c)(1),
(2) Date: Apr. 13, 2021

(87) PCT Pub. No.: WO2020/079624
PCT Pub. Date: Apr. 23, 2020

(65) Prior Publication Data

US 2022/0024224 A1 Jan. 27, 2022

(30) Foreign Application Priority Data

Oct. 18, 2018 (IT) ..... 102018000009578

(51) Int. Cl.
*B41J 3/407* (2006.01)
*B41J 11/00* (2006.01)

(52) U.S. Cl.
CPC ..... *B41J 3/407* (2013.01); *B41J 3/4073* (2013.01); *B41J 11/0095* (2013.01)

(58) Field of Classification Search
CPC ..... B41J 3/407; B41J 3/4073; B41J 11/0095
See application file for complete search history.

(56) References Cited

U.S. PATENT DOCUMENTS

| | | | |
|---|---|---|---|
| 5,204,944 | A | 4/1993 | Wolberg et al. |
| 5,606,534 | A | 2/1997 | Stringer et al. |
| 10,529,090 | B2 | 1/2020 | Giardino et al. |
| 10,699,380 | B2 | 6/2020 | Giardino et al. |

(Continued)

FOREIGN PATENT DOCUMENTS

| | | | |
|---|---|---|---|
| EP | 0269287 | A2 | 6/1988 |
| EP | 2026249 | A1 | 2/2009 |

(Continued)

OTHER PUBLICATIONS

International Search Report for International Application No. PCT/IB2017/051257 filed Mar. 3, 2017 on behalf of System S.P.A., dated Jun. 26, 2017. 4 pages.

(Continued)

*Primary Examiner* — David H Banh
(74) *Attorney, Agent, or Firm* — Steinfl + Bruno LLP

(57) ABSTRACT

A device for locating a moving glass support is described. A conveyor roller surface is arranged to generate movement of the glass support. The device illuminates the glass support and acquires a plurality of lines of the moving glass support. A primary image is generated as a function of the acquired plurality of lines. A plurality of representative points of the glass support are detected from the primary image. Location coordinates of the glass support are calculated as a function of the plurality of representative points. A system for printing on the glass support inclusive of the locating device is further described.

14 Claims, 9 Drawing Sheets

(56) References Cited

U.S. PATENT DOCUMENTS

| | | | | |
|---|---|---|---|---|
| 2002/0149805 | A1 | 10/2002 | Tanaka et al. | |
| 2009/0039157 | A1 | 2/2009 | Reichenbach et al. | |
| 2012/0256995 | A1 | 10/2012 | Holzewr | |
| 2012/0307041 | A1* | 12/2012 | Fujiwara | G01N 21/8422 348/E5.049 |
| 2013/0208290 | A1 | 8/2013 | Ikari | |
| 2013/0278756 | A1* | 10/2013 | Ljubicic | G01B 11/028 348/135 |
| 2014/0320868 | A1 | 10/2014 | Shaked et al. | |
| 2016/0378042 | A1 | 12/2016 | Tanaka et al. | |
| 2019/0051012 | A1* | 2/2019 | Giardino | G06T 7/0004 |
| 2019/0066267 | A1 | 2/2019 | Giardino et al. | |

FOREIGN PATENT DOCUMENTS

| | | | |
|---|---|---|---|
| EP | 2905143 | A1 | 8/2015 |
| JP | 2007041990 | A | 2/2007 |
| WO | 2013/005204 | A1 | 1/2013 |
| WO | 2017/149508 | A1 | 9/2017 |
| WO | 2017/149509 | A1 | 9/2017 |

OTHER PUBLICATIONS

International Search Report for International Patent Application No. PCT/IB2017/051256 filed Mar. 3, 2017 on behalf of System S.P.A., dated Jun. 8, 2017. 3 pages.

International Search Report for International Patent Application No. PCT/IB2019/058845 filed Oct. 17, 2019 on behalf of System S.P.A., dated Jan. 15, 2020. 5 pages.

Non-Final Office Action for U.S. Appl. No. 16/078,519, filed Aug. 21, 2018 on behalf of System SPA, dated Apr. 24, 2019. 20 pages.

Non-Final Office Action for U.S. Appl. No. 16/078,587, filed Aug. 21, 2018 on behalf of System S.P.A dated Dec. 12, 2019 12 pages.

Notice of Allowance for U.S. Appl. No. 16/078,519, filed Aug. 21, 2018 on behalf of System SPA, dated Oct. 22, 2019. 10 pages.

Notice of Allowance for U.S. Appl. No. 16/078,587, filed Aug. 21, 2018 on behalf of System S.P.A., dated Mar. 10, 2020. 10 Pages.

Wallis, J.W. et al., "An Optimal Rotator for Iterative Reconstruction", IEEE Transactions on Medical Imaging, vol. 16, No. 1, pp. 118-123,(Feb. 1997).

Wolberg, G. "Digital Image Warping—Ch.3 Spatial Transformations & Ch. 5 Image Resampling", pp. 41-94, 117-161. Wiley—IEEE Computer Society Press.Aug. 1990. 99 pages.

Written Opinion for International Application No. PCT/IB2017/051256 filed Mar. 3, 2017 on behalf of System S.P.A., dated Jun. 8, 2017. 7 pages.

Written Opinion for International Application No. PCT/IB2017/051257 filed Mar. 3, 2017 on behalf of System S.P.A., dated Jun. 26, 2017. 6 pages.

Written Opinion for International Application No. PCT/IB2019/058845 filed Oct. 17, 2019 on behalf of System S.P.A., dated Jan. 15, 2020. 6 pages.

* cited by examiner

DEVICES AND SYSTEMS FOR LOCATING AND PRINTING ON GLASS SUPPORTS

CROSS-REFERENCE TO RELATED APPLICATIONS

The present application is the U.S. National Stage of International Patent Application No. PCT/IB2019/058845 filed on Oct. 17, 2019 which, in turn, claims priority to Italian Patent Application No. 102018000009578 filed on Oct. 18, 2018.

FIELD OF APPLICATION

The present invention relates to a method for locating a glass support and a corresponding locating device.

The present invention further relates to a method for printing an image on of a glass support comprising the aforesaid locating method.

The present invention further relates to a system for printing an image on a glass support comprising the aforesaid device for locating a glass support.

The invention makes reference to locating glass supports such as, in particular, glass sheets of varying shape and size and the description that follows makes reference to this field of application.

PRIOR ART

In systems set up for printing on glass, the step of arranging the glass sheets on a conveyor means for subsequent printing is particularly delicate, since the image or decoration to be printed must be positioned in a predetermined manner inside the perimeter of the glass sheet.

Given that in the rigid prior art systems, printing takes place with the glass sheet to be printed on stationary in one point of the system; this means that the glass sheets must be positioned precisely so as to receive a print on them. In particular, in printing with serigraphic meshes, the glass sheet must be positioned below the mesh precisely so that during printing it is centred within the edges of the sheet itself. In printing with ink jet devices as well, in the prior art the glass sheet must be stopped below the printing device and positioned precisely so as to avoid printing errors during the various passes of the printing head moving over the glass sheet itself, as occurs in a printing plotter system, known in the sector.

The object of the present invention is to provide a method and a device for locating a glass support in movement on a conveyor means which contributes to solving the aforesaid problems by overcoming the drawbacks of the prior art.

A further object of the present invention is to provide a method and a system for printing on a glass support in movement on a conveyor means which contributes to solving the aforesaid problems by overcoming the drawbacks of the prior art.

A specific object is to provide a method/device for locating a glass support arranged in a printing method/system, which contributes to solving the aforesaid problems by overcoming the drawbacks of the prior art.

SUMMARY OF THE INVENTION

In a first aspect, the invention discloses a method for locating a glass support, wherein said glass support is moving, comprising the steps of:

- providing a conveyor surface of the conveyor roller type arranged so as to generate said movement of said glass support, wherein said movement occurs at a selectable speed and in a feed direction;
- providing illumination means for the glass support, configured to illuminate said glass support in movement on said conveyor rollers;
- acquiring a predetermined plurality of lines of said glass support in movement, as a function of a line frequency which is defined in turn as a function of an acquisition rate;
- generating a primary image as a function of said acquired predetermined plurality of lines;
- detecting from said primary image a plurality of representative points of said glass support, wherein the coordinates of said plurality of points are expressed in relation to a first predefined reference;
- calculating location coordinates of said glass support relative to said first predefined reference as a function of said plurality of representative points.

Preferably, there is envisaged a step of loading a graphic file describing a theoretical contour of said glass support in movement on said conveyor surface.

Preferably, said plurality of points is representative of an actual contour of said glass support.

Preferably, the step of calculating said location coordinates of said glass support relative to said first predefined reference as a function of said plurality of representative points is carried out by means of a fitting algorithm between said actual contour of said glass support, determined by said plurality of points, and said theoretical contour of said glass support.

Preferably, said fitting algorithm comprises the steps of:

- applying a rotation-translation of a predefined entity to said theoretical contour;
- calculating the average distance between said actual contour and said rotated-translated theoretical contour;
- searching for the minimum point of the calculated distance function;
- disturbing the rotation-translation by a certain amount;
- recalculating the average distance in an iterative way;
- stopping when the difference between the calculated minimum distances is less than a predetermined reference value.

Preferably, the graphic file describes a plurality of theoretical contours of different said glass supports adapted to move on said conveyor surface.

Preferably, said step of calculating said location coordinates of said glass support relative to said first predefined reference as a function of said plurality of representative points is carried out by means of a fitting algorithm between said actual contour of said glass support, determined by said plurality of points, and every theoretical contour of said plurality of theoretical contours of said different glass supports adapted to move on said conveyor surface.

Preferably, said fitting algorithm comprises, for every said theoretical contour of said plurality of theoretical contours of different said glass supports, the steps of:

- applying a rotation-translation of a predefined entity to said theoretical contour;
- calculating the average distance between said actual contour and said rotated-translated theoretical contour;
- searching for the minimum point of the calculated distance function;
- disturbing the rotation-translation by a certain amount;
- recalculating the average distance in an iterative way;

stopping when the difference between the calculated minimum distances is less than a predetermined reference value;

calculating the minimum between the average distances between said actual contour and said rotated-translated theoretical contour, calculated for every said theoretical contour of said plurality of theoretical contours of different said glass supports;

identifying said location coordinates of said glass support on the basis of the identified theoretical contour of said plurality of theoretical contours.

Preferably, there is envisaged a step of providing said illumination means for the glass support configured to carry out said step of illuminating said glass support in movement on said conveyor rollers; and providing acquisition means configured to carry out said step of acquiring a predetermined plurality of lines of said glass support in movement, as a function of a line frequency which is defined in turn as a function of an acquisition rate; wherein said illumination means and said acquisition means are positioned on a same side relative to the conveyor surface.

Preferably, there is envisaged a step of providing that the illumination means emit a light beam incident on said conveyor surface according to an angle of incidence, wherein the generated beam of light appears as a linear stripe which is orthogonal to the feed direction.

Preferably, said angle of incidence has a first width such as to ensure a sufficient reflection of said glass support illuminated by said illumination means.

Preferably, said angle of incidence has a second width comprised between 87° and 93°, substantially coincident with 90° in an optimal solution.

Preferably, there is envisaged a step of sending a printing command configured to command printing on said printing support as a function of said locating that has taken place.

Preferably, there is envisaged a step of acquiring said predetermined plurality of lines of said glass support from different acquisition points substantially transversally relative to said feed direction.

Preferably, there is envisaged a step of detecting a plurality of glass supports in movement on said conveyor surface of the conveyor roller type, wherein said glass supports are moving in parallel rows on a single conveyor surface.

Preferably, there is envisaged a step of providing a plurality of acquisition means which are arranged so as to detect said glass supports moving in parallel rows.

Preferably, there is envisaged a step of acquiring, by acquisition means, said predetermined plurality of lines in an interaxis between said conveyor rollers.

In a second aspect, the invention discloses a device for locating a glass support, wherein said glass support is in movement on a conveyor surface of the conveyor roller type in a feed direction and at a selectable speed, wherein the device comprises:

illumination means for said glass support configured to illuminate said glass support in movement on said conveyor rollers;

acquisition means configured to acquire a predetermined plurality of lines of said glass support in movement as a function of a line frequency which is defined in turn as a function of an acquisition rate;

wherein said acquisition means are configured to acquire said predetermined plurality of lines;

a processing unit, in data connection with said acquisition means, comprising: a receiving module configured to receive said predetermined plurality of lines acquired by said acquisition means;

a generation module configured to generate a primary image as a function of said acquired predetermined plurality of lines;

a detection module configured to detect from said primary image a plurality of representative points of said glass support, wherein the coordinates of said plurality of points are expressed in relation to a first predefined reference;

a locating module configured to:

receive, as input, said plurality of representative points;

calculate location coordinates of said glass support relative to said first predefined reference, as a function of said plurality of representative points.

Preferably, the processing unit further comprises a loading module configured to load a graphic file describing a theoretical contour of said glass support in movement on said conveyor surface.

Preferably, said plurality of points is representative of an actual contour of said glass support.

Preferably, said locating module is configured to calculate said location coordinates of said glass support relative to said first predefined reference as a function of said plurality of representative points, wherein said calculation executes a fitting algorithm between said actual contour of said glass support, determined by said plurality of points, and said theoretical contour of said glass support.

Preferably, in said locating module, said fitting algorithm comprises the steps of:

applying a rotation-translation of a predefined entity to said theoretical contour;

calculating the average distance between said actual contour and said rotated-translated theoretical contour;

searching for the minimum point of the calculated distance function;

disturbing the rotation-translation by a certain amount;

recalculating the average distance in an iterative way;

stopping when the difference between the calculated minimum distances is less than a predetermined reference value.

Preferably, said graphic file describes a plurality of theoretical contours of different said glass supports adapted to move on said conveyor surface.

Preferably, said locating module is configured to calculate said location coordinates of said glass support relative to said first predefined reference as a function of said pluralities of representative points by means of a fitting algorithm between said actual contour of said glass support, determined by said plurality of points, and every theoretical contour of said plurality of theoretical contours of said different glass supports adapted to move on said conveyor surface.

Preferably, in said locating module, said fitting algorithm comprises, for every said theoretical contour of said plurality of theoretical contours of different said glass supports, the steps of:

applying a rotation-translation of a predefined entity to said theoretical contour;

calculating the average distance between said actual contour and said rotated-translated theoretical contour;

searching for the minimum point of the calculated distance function;

disturbing the rotation-translation by a certain amount;

recalculating the average distance in an iterative way;

stopping when the difference between the calculated minimum distances is less than a predetermined reference value;

calculating the minimum between the average distances between said actual contour and said rotated-translated theoretical contour, calculated for every said theoretical contour of said plurality of theoretical contours of different said glass supports;

identifying said location coordinates of said glass support on the basis of the identified theoretical contour of said plurality of theoretical contours.

Preferably, said illumination means and said acquisition means are positioned on a same side relative to the conveyor surface.

Preferably, said illumination means are configured to emit a light beam incident on the conveyor surface according to a predetermined angle, wherein the light beam generated appears as a linear stripe, orthogonal to the feed direction.

Preferably, said angle of incidence has a first width such as to ensure a sufficient reflection of said glass support (1) illuminated by said illumination means.

Preferably, said angle of incidence has a second width comprised between 87° and 93°, substantially coincident with 90° in an optimal solution.

Preferably, said locating module is configured to acquire a predetermined plurality of lines of said glass support from different acquisition points substantially transversally relative to said feed direction.

Preferably, said locating module is configured to detect a plurality of glass supports in movement on said conveyor surface of the conveyor roller type, wherein said glass supports are moving in parallel rows on a single conveyor surface.

Preferably, said device comprises a plurality of acquisition means arranged so as to detect said glass supports moving in parallel rows.

In a third aspect, the invention discloses a method of digital printing on glass supports comprising the steps of:

providing at least one glass support;

providing a digital image (I_dgt) to be printed on said at least one glass support;

providing a printing apparatus comprising at least one printing support bar which supports a plurality of print heads, configured to print said digital image on said at least one glass support;

feeding, with a random orientation said at least one glass support to said printing apparatus on a conveyor surface of the conveyor roller type, at a selectable speed and in a predefined direction;

locating said at least one glass support infed to said printing apparatus on said conveyor surface according to the locating method of the first aspect, thereby determining location coordinates of said glass support relative to a first predefined reference;

rotating-translating said digital image as a function of said positioning coordinates of said glass support, thereby determining a rotated-translated digital print image for said glass support;

printing said rotated-translated print image on said glass support, maintaining the orientation of said glass support unchanged relative to a second predefined reference.

Preferably, there is envisaged a step of providing a plurality of glass supports in movement on a single said conveyor surface along parallel rows;

there is envisaged a step of printing on said glass supports in advancement without interruption on said parallel rows.

In a fourth aspect, the invention discloses a system for digital printing on glass supports comprising:

an insertion interface configured to receive a digital image to be printed on at least one glass support;

a conveyor surface of the conveyor roller type configured to convey said at least one glass support with a random orientation towards a printing apparatus at a selectable speed and in a predefined direction;

said printing apparatus comprising at least one printing support bar which supports a plurality of print heads configured to print said digital image on said at least one glass support;

a locating device, positioned on the infeed side of said apparatus, and configured to locate said at least one glass support moving with a random orientation on said conveyor surface, according to what was described in the second aspect of the invention, thereby determining location coordinates of said glass support relative to a first predefined reference;

a processing unit, in data connection with said printing apparatus and with said locating device, comprising:

a rotation module configured to rotate-translate said digital image as a function of said positioning coordinates of said glass support, thereby determining a rotated-translated digital print image for said glass support;

wherein said plurality of print heads is configured to print said digital image on said at least one glass support, maintaining the orientation of said glass support unchanged relative to a second predefined reference.

Preferably, said conveyor surface of the conveyor roller type is arranged so as to move a plurality of glass supports along parallel rows.

Preferably, said plurality of print heads is configured to print on said glass supports in advancement without interruption on said parallel rows.

The provision, according to the invention, of a precise location of a glass support, in movement on a conveyor means, enables precise, reliable processing of the data related to the glass support.

The provision, according to the invention, of a precise location of glass supports, i.e. a precise identification of the positioning of the glass supports on the infeed side of a printing apparatus, makes it possible to print on the glass support without having to stop it below the printing system itself, thus ensuring a more efficient and flexible printing system/method.

In particular, the invention, as described, achieves the following technical effects, as compared to the prior art:

precise and reliable processing of the data related to the glass support due to the precise location of the glass support in movement on a conveyor means;

lower risk of damage to the glass supports as no mechanical rotation or mechanical positioning of the latter is required to correct their orientation;

no need to have infed glass supports oriented in an optimal manner, which makes it possible to considerably reduce the time of preparing the printing substrates and printing times;

separability of the stations of the system, production efficiency, by virtue of the fact that production times are no longer dependent on the sum of the times of stations arranged in series in the system and separable neither physically, nor in terms of sequential timing;

more efficient maintenance, by virtue of the fact that one station can undergo inspection without blocking the others;

a better reaction to malfunctions, by virtue of the fact that a malfunction in one station will not block the entire system, as the station can be momentarily replaced by another similar one.

The technical effects/advantages cited and other technical effects/advantages of the invention will emerge in further detail from the following description of an example embodiment, provided by way of approximate and non-limiting illustration with reference to the attached drawings.

DETAILED DESCRIPTION

The present invention relates to a method and device for locating a glass support, in particular to implement a method and system of digital printing on glass supports in movement on conveyor means.

In a preferred embodiment, described below, the glass supports comprise glass sheets. In particular, some examples of glass sheets refer to windows or windscreens for motor vehicles, which normally have irregular profiles or shapes that cannot be likened to particular geometric shapes, as in the case, for example, of rectangular ceramic tiles. For example, glass sheets for motor vehicles are decorated by affixing logos and/or various wording, as well as by affixing dark opaque bands along the edge areas. In order to be able to print on a glass sheet moving on a roller conveyor in a precise manner with a digital printing device it is necessary to identify its position in an equally precise manner and to identify the contour.

Other examples of glass supports refer to decorative panes or glass for cooktops or glass items in general where a precise location of the glass sheet moving on the conveyor means is necessary in order to be able to carry out "single-pass" digital printing thereupon, that is, without stopping the glass sheet.

In a possible embodiment of the invention, the locating device can also be positioned before a printing station of the plotter type. In this configuration, the glass support moved below the locating device enters the digital printing station, where its movement is halted and it is printed while stationary and where the printing bar on which the print heads are mounted is moved.

The locating device of the invention has the object of providing the digital printing machine with a series of precise information regarding the position and angle of the infed glass support 1.

Since the invention is intended to be used in the presence of the acceleration of gravity g, it is understood that the latter univocally defines the vertical direction. Similarly, it is understood that the terms "high", "upper", "above", "height" and the like are univocally defined on the basis of the acceleration of gravity g relative to the terms "low", "lower", "below", "bottom" and the like.

The vertical direction also identifies the planes perpendicular to it as "horizontal" planes. Moreover, in the description that follows, "height" means the vertical dimension and "width" the horizontal dimension.

Figure 1:
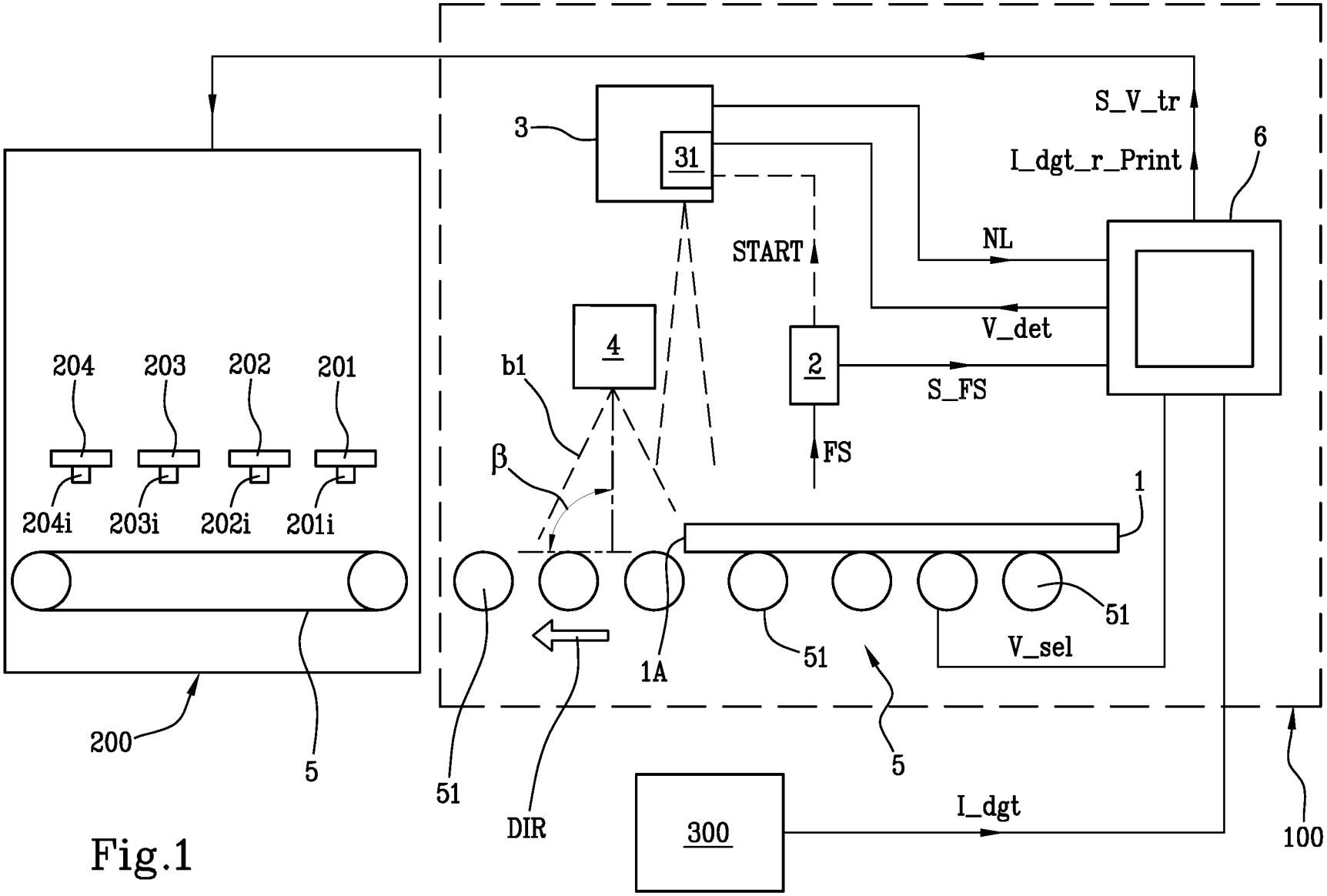
FIG. 1 is a schematic view of a device for locating a glass support, according to the invention.

With particular reference to FIG. 1, it shows a device 100 for locating the aforesaid glass support 1, wherein the glass support is moving on a conveyor surface 5 at a selectable speed V_sel and in a feed direction Dir.

According to the invention, the conveyor surface 5 is of the conveyor roller type 51.

The technical effect achieved is to enable imaging, by means of acquisition means described below, which is immune to interference caused by other components, for example the interference provoked by the conventional conveyor belt used, in particular, in printing on tiles.

In other words, as the conveyor system is of the roller rather than belt type, the acquisition means/cameras are able to read in an empty space, i.e. in the interaxis between roller and roller. This prevents the interference of a belt from appearing in the acquired image.

The use of a belt conveyor system does not, however, prevent the operation of the locating device 100.

The locating device 100 further comprises illumination means 4 for the glass support 1 configured to illuminate the glass support 1 in movement on the conveyor rollers 51.

In particular, the illumination means 4 are configured to emit a light beam b1 incident on the conveyor surface 5 according to a predetermined angle β.

Preferably, in a non-optimal embodiment, the predetermined angle β has a width Amp_β defined according to the nature of the glass support 1 to be illuminated.

The width Amp_β is such as to ensure a sufficient reflection of the glass support 1 illuminated by the illumination means 4.

In a preferred embodiment of the invention, the angle of incidence β has a second width Amp_β comprised between 87° and 93°, and substantially coincident with 90° in the optimal solution; this is the case with a printing machine on reflecting supports such as, for example, glass sheets.

The technical effect achieved is to have the surface of the glass reflecting completely without interferences; in other words, the illuminator exploits the reflective property of the glass.

A 90° angle of incidence and the use of a roller conveyor surface jointly provide the technical effect of improving the quality of the image acquired; this type of illumination is commonly called coaxial, since the camera and illuminator form the same angle of incidence. This enables the amount of light reflected from the surface of the glass to be maximized.

It will be understood from what has been described up to now and what is described below and shown in FIGS. 1, 3 and 4 that, in the preferred embodiment of the invention, the illumination system and the acquisition system are positioned above the roller conveyor surface.

In particular, the illumination system comprises the illumination means 4, and the acquisition system comprises acquisition means 2, 3.

In a possible embodiment, the illumination system and the acquisition system are positioned below the roller conveyor surface.

In other words, the illumination system and the acquisition system, are positioned on a same side relative to the roller conveyor surface.

For example, the illumination system and the acquisition system are positioned above the roller conveyor surface.

Alternatively, the illumination system and the acquisition system are positioned below the roller conveyor surface.

In a preferred embodiment of the invention, the illumination means 4 comprises a LED-type illuminator, preferably with a concentric cylindrical lens.

The light beam b1 generated appears as a linear stripe, orthogonal to the feed direction Dir.

In other words, the technical effect achieved by the use of a roller conveyor surface is an illumination of the visual field of the camera during the acquisition of the glass support 1. The position of the illuminator and the particular 90° angle present between the light beam b1 and the conveyor surface 5 are selected in such a way as to maximize the illumination of the surface of the printing support 1 and avoid reflections of third components.

The device further comprises acquisition means 2,3 configured to acquire a predetermined plurality of lines NL of the glass support 1 in movement, as a function of a line frequency FL, which is defined in turn as a function of an acquisition rate V_det. In a preferred embodiment of the invention, the line frequency FL is proportional to the acquisition rate V_det.

In other words, the acquisition means 2,3 provide a single two-dimensional image I_PR formed by the concatenation of the predetermined number NL of lines acquired at a line frequency FL determined on the basis of the acquisition rate V_det.

According to the invention, the acquisition is carried out in an interaxis between the conveyor rollers 51.

The technical effect achieved, which is added to the ones described in reference to the use of a roller conveyor surface and the 90° angle between the light beam b1 and the conveyor surface 5, is to have the surface of the glass reflecting completely, without the interference of third objects.

Preferably, the acquisition of the primary image I_PR of the support 1 takes place on the basis of a Start acquisition activation signal.

From the analysis of the primary image I_PR, the invention derives the profile of the glass supports 1 represented by points Pi described below.

In a preferred embodiment of the invention, the acquisition means 2,3 comprise first acquisition means 2, in particular a high-precision photocell.

According to the invention, the first acquisition means 2 is configured to detect a front 1A of the glass support 1 advancing on the conveyor surface 5 in the feed direction Dir. Furthermore, the first acquisition means 2 is configured to generate the Start activation signal on the basis of the detection that has taken place.

In a preferred embodiment of the invention, the acquisition means 2,3 further comprise a second acquisition means 3, in particular a high-resolution camera.

Preferably, the camera has a fixed-focus lens set on the surface of the glass support 1; a good depth of field of the lens ensures that the focus is acceptable under any conditions.

Preferably, the camera is placed above the conveyor surface so as to be able to reconstruct an image by successive scans.

The second acquisition means 3 is configured to acquire a predetermined plurality of lines NL of the glass support 1.

With reference to FIG. 1, the acquisition means 3 preferably comprises an activation module 31 configured to activate the acquisition.

According to the invention, the first acquisition means 2 is further configured to send the Start activation signal to the activation module 31 based on the detection of the front 1A. The activation module 31 is configured to remain always on standby for a new Start activation signal.

Figure 2:
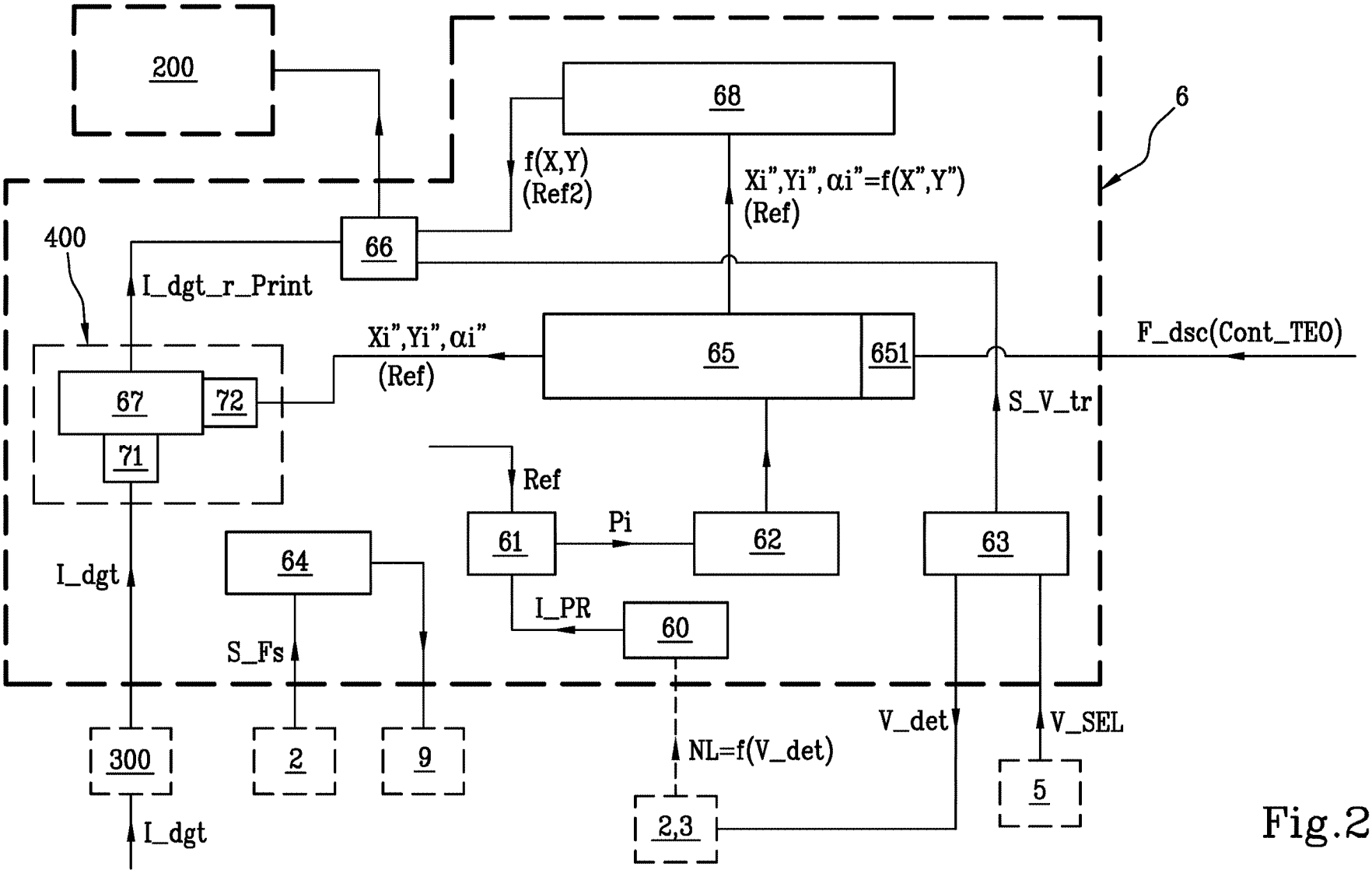
FIG. 2 is a block diagram of a specific unit of the device shown in FIG. 1.

With particular reference to FIG. 2, the invention comprises a processing unit 6 in data connection at least with the acquisition means 2,3.

In particular, the processing unit 6 is connected to the acquisition means via a high-speed connection.

In general, it should be noted that in the present context and in the claims herein below, the processing unit 6 is presented as being subdivided into distinct functional modules (memory modules or operating modules) for the sole purpose of describing the functions thereof clearly and thoroughly.

Actually, this processing unit 6 can be constituted by a single electronic device, suitably programmed for performing the functions described, and the various modules can correspond to a hardware entity and/or routine software that are part of the programmed device.

Alternatively, or additionally, these functions can be performed by a plurality of electronic devices over which the above-mentioned functional modules can be distributed.

The processing unit 6 can also make use of one or more processors for execution of the instructions contained in the memory modules.

The above-mentioned functional modules can also be distributed over different computers, locally or remotely, based on the architecture of the network in which they reside.

The processing unit 6 is configured to process data representative of the position and conformation of glass supports based on the predetermined plurality of lines NL acquired by the acquisition means 2,3.

The processing unit 6 will be described in detail with reference to FIG. 2.

The processing unit 6 comprises a receiver module 60 configured to receive the predetermined plurality of lines NL acquired by the acquisition means 2,3.

According to the invention, the processing unit 6 comprises a generation module 61 configured to generate a primary image I_PR on the basis of the acquired predetermined plurality of lines NL.

According to the invention, the processing unit 6 comprises a detection module 62, in data connection with the generation module 61, and configured to detect, from the generated primary image I_PR, a plurality of representative points Pi of the glass support 1, wherein the coordinates of the plurality of points Pi are expressed in relation to a first predefined reference Ref.

According to the invention, the plurality of points Pi is representative of an actual contour Cont_EFF of the glass support 1.

In alternative embodiments, the plurality of points Pi can be representative of one or more among vertices of the glass support, centres of holes in the glass support, previous decorations of the glass support, parts in relief present on the glass support, markers present on the glass support or the like.

The processing unit 6 further comprises a loading module 651 configured to load a graphic file F_dsc describing a theoretical contour Cont_TEO of the glass support 1 in movement on the conveyor surface 5.

Preferably, the graphic file F_dsc is representative of the geometry or contour of the glass support 1, which will serve as a reference to determine the position of the glass support on the rollers 51 of the conveyor surface 5.

In particular, the graphic file F_dsc is a raster map of the theoretical contour Cont_TEO of the edge of the piece, expressed in the reference system of the graphic file.

Alternatively, the graphic file F_dsc is a vector file directly containing the coordinates of the points of the profile or contour of the glass.

Alternatively or in addition, the loading module 651 is configured to load the graphic file F_dsc describing a plurality of theoretical contours P_Cont_TEO of different glass supports 1 adapted to move on the conveyor surface 5.

The processing unit 6 further comprises a first processing module 63 configured to receive, as input, the selectable speed V_sel, calculate an acquisition rate V_det of the predetermined plurality of lines NL and send the acquisition rate V_det to the acquisition means 2,3 (FIGS. 1 and 2).

According to the invention, the first processing module 63 is configured to calculate the acquisition rate V_det of the predetermined plurality of lines NL as a function of the selectable speed V_sel.

In other words, V_det=f (V_Sel).

In a preferred embodiment of the invention, V_det=V_Sel.

Based on what is computed by the first processing module 63, the generation module 61 is configured to generate the primary image I_PR as a function of the predetermined plurality of lines NL acquired at the acquisition rate V_det, which is in turn defined on the basis of the selectable speed V_sel.

In a preferred embodiment of the invention, V_det is represented by a pulse train signal. According to the invention, the acquisition rate V_det represented by a pulse train signal is synchronous with the signal representative of the selectable speed V_sel.

The processing unit 6 comprises a locating module 65 configured to receive, as input, the plurality of representative points Pi and to calculate location coordinates Xi",Yi",αi" of the glass support 1 relative to the first predefined reference Ref as a function of the plurality of representative points Pi.

According to the invention, the locating module 65 executes a fitting algorithm to between the actual contour Cont_EFF and the theoretical contour Cont_TEO of the glass support 1.

Through a best fit method one obtains F(x,y,a) the transformation necessary in order for the theoretical contour Cont_TEO to be overlaid on the contour Cont_EFF of the edge of the piece in transit, minimizing the distance errors.

Given that the theoretical contour and the printed graphics share the same reference system, the transformation found is none other than a rotation-translation to be applied to the graphics to be printed on the piece.

In other words, the locating module 65 is configured to:

- apply a rotation-translation of a predefined entity X, Y, A to said theoretical contour Cont_TEO;
- calculate the average distance D_avg between said actual contour Cont_EFF and said rotated-translated theoretical contour Cont_TEO;
- search for the minimum point D_MIN of the calculated distance function;
- disturb the rotation-translation by a certain amount dx, dy, da;
- recalculate the average distance D_avg in an iterative way;
- stop when the difference between the calculated minimum distances D_MIN calculated is less than a predefined reference value D_ref The stopping of the algorithm defines the best approximation of the theoretical contour Cont_TEO to the actual contour Cont_EFF.

In other words, the fitting algorithm applied is an iterative cost function minimization algorithm, described in detail here.

From an image obtained by the camera on the infeed side and the descriptor file of the contour map the algorithm extracts two contours called piece contour Cont_EFF and theoretical contour Cont_TEO.

The algorithm applies a rotation-translation of an entity (X, Y, A) to the theoretical contour.

The algorithm executes a cost function which calculates the average distance between the contour of the piece and the rotated-translated theoretical contour.

In searching for the minimum point of the distance function, the algorithm disturbs the rotation-translation by a certain amount (dx, dy, da) and recalculates the cost function in an iterative way.

The algorithm stops when it is no longer possible to minimize the cost function or when the iteration gain is lower than an epsilon value.

Generalizing the system, the distance function could refer to another descriptor (among those mentioned previously in the description) previously extracted from the piece in transit and from the contour map file.

In the event that the pieces in transit are not all identical, but rather there exists a set of possible pieces which can transit in an unpredictable manner, i.e. there exists a plurality of detectable actual contours Cont_EFF, the fitting algorithm has the task of determining the nature of the piece in transit, i.e. the corresponding theoretical contour Cont_EFF among a plurality of identifiable theoretical contours P_Cont_TEO.

In order to do this, the fitting algorithm is run using as a model each of the available theoretical models Cont_TEO, i.e. the plurality of identifiable theoretical contours P_Cont_TEO, and the result of the cost function is calculated for each one.

The rotated-translated theoretical model Cont_TEO that has the minimum cost function, i.e. the minimum average distance D_avg between the actual contour Cont_EFF and the rotated-translated theoretical contour Cont_TEO, will be the one that determines the graphics to be printed, in addition to the position thereof.

In other words, the step of calculating the location coordinates Xi",Yi",αi" of the glass support 1 relative to the first predefined reference Ref as a function of the plurality of representative points Pi is carried out by means of a fitting algorithm between the actual contour Cont_EFF of the glass support 1, determined by the plurality of points Pi, and every theoretical contour Cont_TEO of the plurality of theoretical contours P_Cont_TEO of different glass supports 1 adapted to move on the conveyor surface 5.

In particular, the fitting algorithm comprises, for every theoretical contour Cont_TEO of the plurality of theoretical contours P_Cont_TEO of different glass supports 1, the steps of:

applying a rotation-translation of a predefined entity (X, Y, A) to said theoretical contour (Cont_TEO);

calculating the average distance (D_avg) between said actual contour (Cont_EFF) and said rotated-translated theoretical contour (Cont_TEO);

searching for the minimum point (D_MIN) of the calculated distance function;

disturbing the rotation-translation by a certain amount (dx, dy, da);

recalculating the average distance (D_avg) in an iterative way;

stopping when the difference between the calculated minimum distances (D_MIN) calculated is less than a predefined reference value (D_ref);

calculating the minimum between the average distances D_avg between the actual contour Cont_EFF and the rotated-translated theoretical contour Cont_TEO, calculated for every theoretical contour Cont_TEO of the plurality of theoretical contours P_Cont_TEO of different glass supports 1;

identifying the location coordinates Xi",Yi",αi" of the glass support 1 on the basis of the identified theoretical contour Cont_TEO of the plurality of theoretical contours P_Cont_TEO.

In particular, scanning of the image takes place in the direction of motion Dir of the conveyor surface 5, synchronously with the pulse train generated on the basis of the selectable speed V_sel.

Preferably, the framed area is about 130×130 mm, more preferably it is about 100×100 mm and can be set according to the format of the glass support.

A composition of successive readings of the representative points Pi enables the determination of the location coordinates Xi",Yi",αi" of the glass support 1 relative to the predefined reference Ref.

In a preferred embodiment of the invention, the first predefined reference Ref is the reference system of the second acquisition means 3, consisting, in particular, of a camera.

Figure 4:
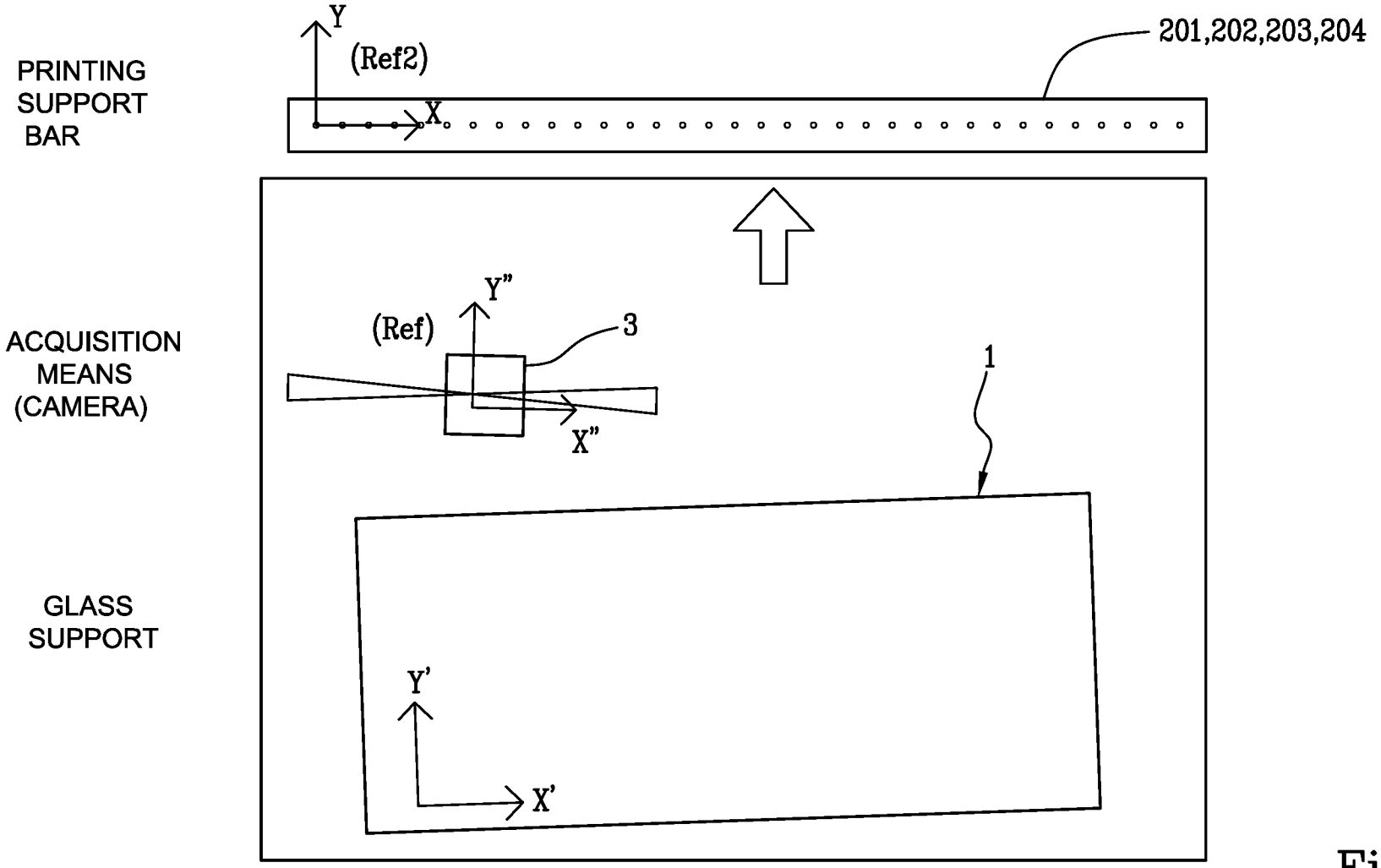
FIG. 4 is a diagram comparing between reference systems, according to the invention.
Figure 5:
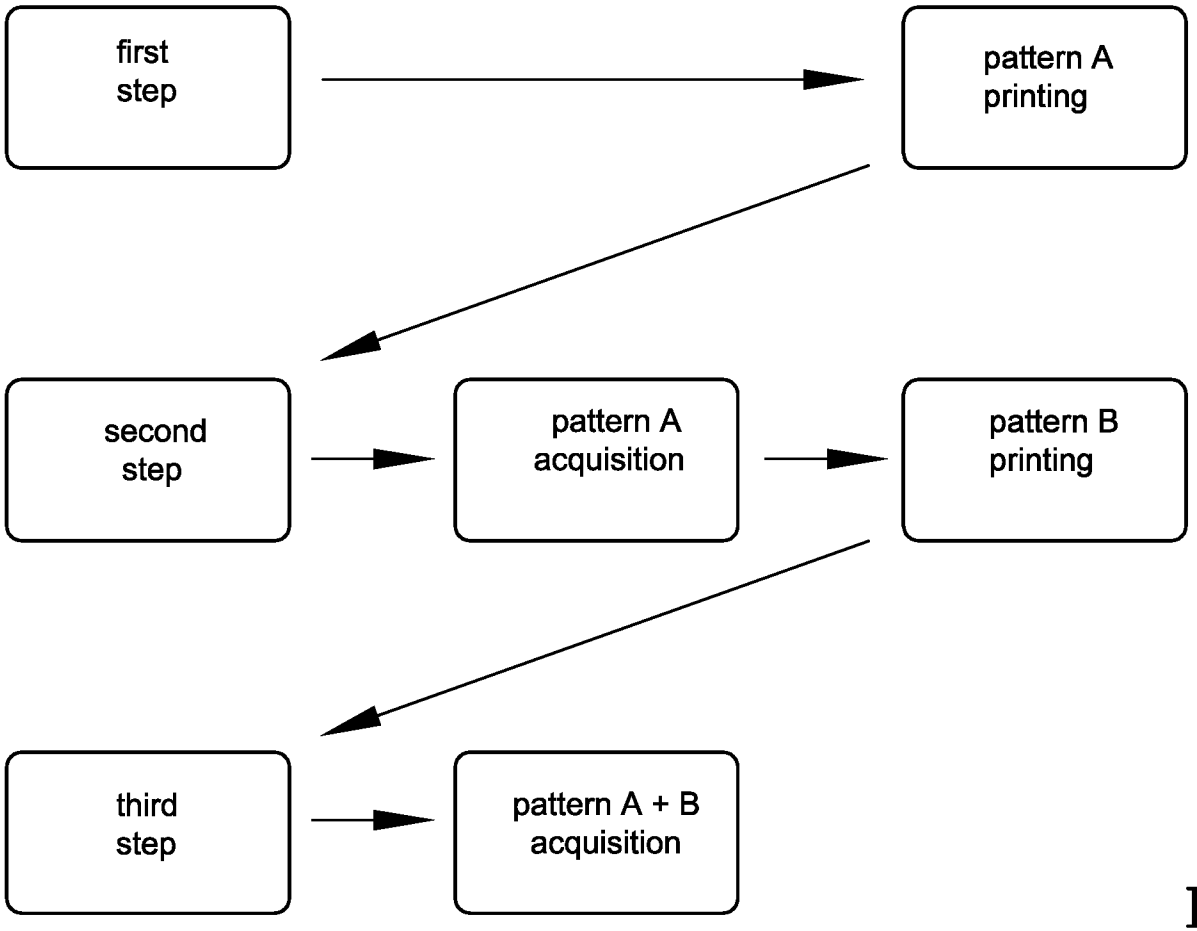
FIG. 5 is a logic diagram of a step of the method of the invention.

The reference system Ref is shown in FIG. 4 together with the other reference systems which will be described below.

Figure 3:
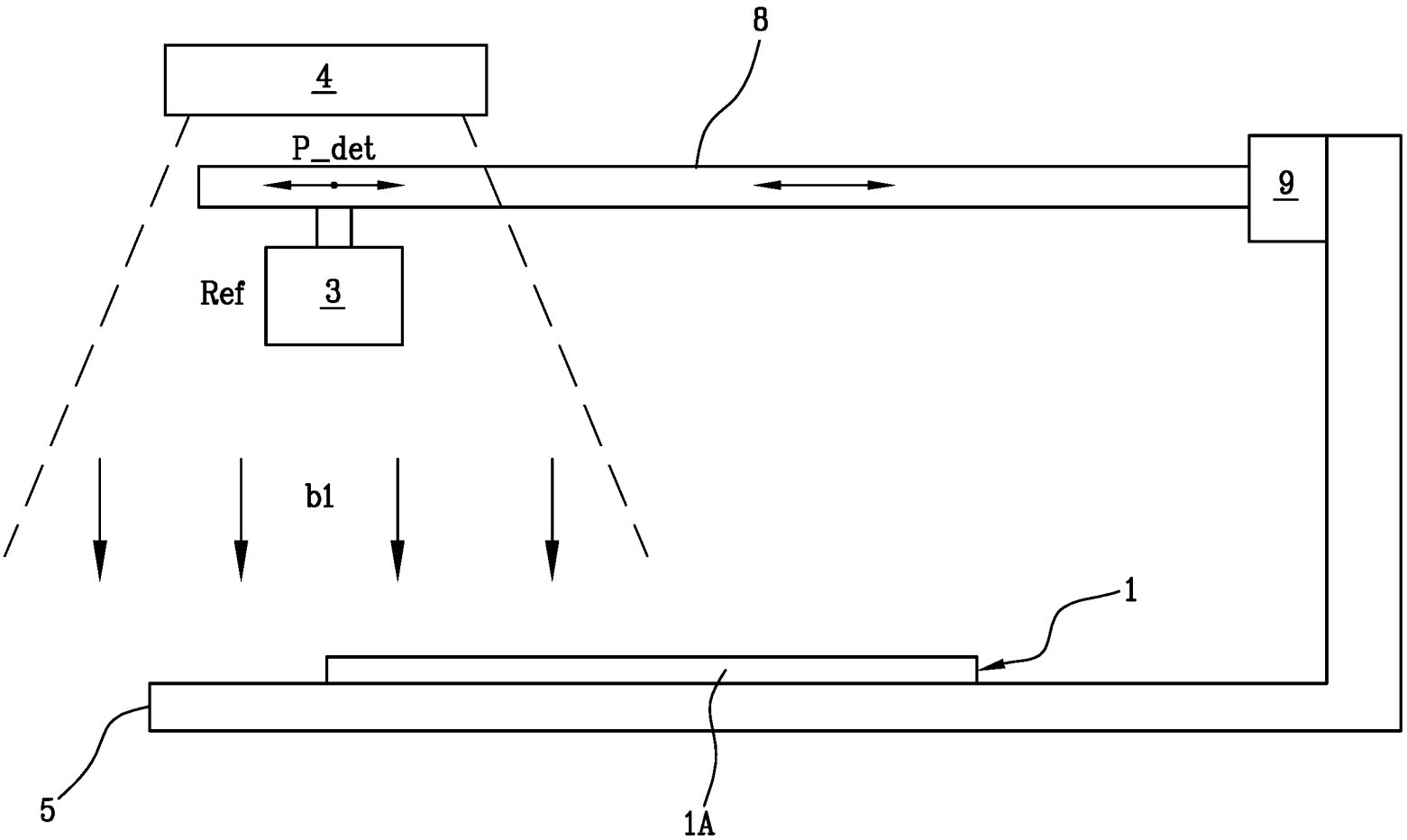
FIG. 3 is a side view of an embodiment of the device for locating a glass support, according to the invention.

With reference to FIG. 3, according to the invention, the second acquisition means 3 and the illumination means 4 are positioned on a linear guide 8 moved by a movement means 9, in particular a high-precision motor.

The technical effect achieved is the positioning, with absolute repeatability, of the acquisition means 3 in proximity to the working position, i.e. in proximity to an acquisition point P_det of the predetermined plurality of lines NL.

The consequent advantage is the possibility of managing glass supports which are very different from one another in terms of recognizable shapes and sizes; in these cases, in fact, once the printing support is detected, the invention provides that the acquisition point P_det of the camera is moved accordingly, in such a way as to optimize the acquisition of the image of the support to be printed in terms of its position in the conveyance system and shape/size.

In other words, with reference to FIG. 3, the locating device 100 comprises the linear guide 8, coupled with the second acquisition means 3 and configured to guide the second acquisition means 3, thereby identifying different acquisition points Pdet of the predetermined plurality of lines NL.

In FIG. 3, the feed direction Dir of the conveyor surface 5 "comes out" orthogonally from the sheet, towards an observer, away from the plane in which the sheet lies; consequently, the glass support 1 moves in a direction "coming out" from the sheet, towards an observer, away from the plane in which the sheet lies.

The device further comprises the movement means 9 associated with the conveyor surface 5, and configured to move the linear guide 8 relative to the feed direction Dir. According to the invention, the movement means 9 is configured to move the linear guide 8 substantially transversely relative to the feed direction Dir.

According to the invention, both or more between the second acquisition means 3 and/or the illumination means 4 are/is coupled to the linear guide 8 in such a way that a movement of the guide determines a variation in position of at least one between the second acquisition means 3 and the illumination means 4, relative to conveyor surface 5.

According to the invention, the first acquisition means 2 is configured to detect a representative portion Fs of the printing support 1 in movement on the conveyor surface 5 in the feed direction Dir.

The first acquisition means 2 is further configured to send to the processing unit 6 a detection signal S_Fs representative of the representative portion detected (FIGS. 1 and 2).

The processing unit 6 comprises a movement module 64 configured to receive the detection signal S_Fs and activate the movement means 9 in such a way as to vary the position of at least one between the second acquisition means 3 and the illumination means 4, relative to the feed direction Dir, as a function of the detection signal S_Fs, thereby varying the acquisition points Pdet of the predetermined plurality of lines NL. Preferably, the movement module 64 is configured to activate the movement means 9 in such a way as to vary the position of at least one between the second acquisition means 3 and the illumination means 4, substantially transversely relative to the feed direction Dir, on the basis of the format signal S_Fs, thereby varying the points of acquisition Pdet of the predetermined plurality of lines NL.

The technical effect achieved is rapid, precise identification of the dimensions of the glass support and of the corresponding optimal acquisition point Pdet for the acquisition of the corresponding predetermined plurality of lines NL.

In the embodiment of the invention described, the conveyor surface 5 of the conveyor roller type 51 is structured in a single line for sequential conveyance of the glass supports 1.

In this embodiment, the second acquisition means 3 comprises a single camera, which can move as described.

In an alternative embodiment, the conveyor surface 5 of the conveyor roller type 51 is structured so as to convey glass supports 1 arranged in parallel rows.

In other words, the glass supports 1 are moving in parallel rows on a single conveyor surface 5.

In this embodiment, the second acquisition means 3 comprises a plurality of cameras. Thus, there is a plurality of acquisition means 3 arranged so as to detect the glass supports 1 moving in parallel rows.

In other words, the acquisition points Pdet are provided for every row of glass supports in movement on the conveyor surface. In still other words, the movement module 64 determines such acquisition points Pdet for every row of glass supports in movement on the conveyor surface.

In a preferred embodiment of the invention, four cameras are provided which are adapted to operate on 1 or 2 or 4 independent rows.

The cameras are positioned in general in such a way as to be able to frame a significant portion of the glass support 1.

In the optimal case of very small objects, the system is capable of photographing and reconstructing the complete contour.

However, in the case of glass items of considerable size, this might not be possible: in this case only a part of the contour is reconstructed.

In general, a part of the contour is considered significant if applying small disturbances (dx, dy, da) to the rotation-translation—as previously described, gives rise to large variations in the distance function.

Based on these considerations, a rectilinear contour portion is scarcely sensitive to translation (dx, dy) but very sensitive to rotation: a circumferential arc, by contrast, will be scarcely sensitive to rotation but very sensitive to translation.

The optimal position, therefore, is usually chosen so as to be able to frame the outer front part of the glass in transit (outer areas of the glass), in proximity to corners or curves with a reduced radius, where present.

In the case of printing on independent rows, every row has only one available camera.

If the pieces travel in a single line, various cameras frame the same piece and the acquired images are processed so as to obtain a single file containing the single acquired images of the edges: this increases the probability of having rectilinear and curvilinear portions available and thus increases the reliability of the distance function, making the system much more robust.

The device described thus far makes it possible to achieve the functionality of a corresponding method for locating a glass support 1, wherein the method comprises the steps of:

- providing a conveyor surface 5 of the conveyor roller type 51 arranged so as to generate the movement of said glass support 1, wherein the movement occurs at a selectable speed V_sel and in a feed direction Dir;
- providing illumination means 4 for the glass support 1 configured to illuminate the glass support 1 in movement on the conveyor rollers 51
- acquiring a predetermined plurality of lines NL of the glass support 1 in movement, as a function of a line frequency FL which is defined in turn as a function of an acquisition rate V_det;
- generating a primary image I_PR on the basis of the acquired predetermined plurality of lines NL;
- detecting from the generated primary image I_PR a plurality of representative points Pi of the glass support 1, wherein the coordinate of the plurality of points Pi are expressed in relation to a first predefined reference Ref;
- calculating location coordinates Xi",Yi",αi" of the glass support 1 relative to the first predefined reference Ref, as a function of the plurality of representative points Pi.

Other steps of the method coincide with the functions of the operating modules of the processing unit 6 or of the components of the above-described locating device 100 and they perform other steps of the method depending on the ones illustrated.

The invention also comprises a method of digital printing on glass support which, among the steps envisaged, also comprises locating a glass support 1 as carried out by the method just described.

The invention also comprises a corresponding system of digital printing on glass supports which comprises the locating device 100 of the invention.

The invention envisages providing at least one glass support 1; for the sake of simplicity, reference will be made to a single glass support in the course of the discussion.

With reference to FIG. 1, the invention in fact comprises the conveyor surface 5 configured to convey at least one glass support 1 towards a printing apparatus 200 at a selectable speed V_sel and in a predefined direction Dir.

For the sake of simplicity, reference will be made hereinafter to one glass support 1, though this is not intended to mean that only a single glass support can be conveyed at a time.

In particular, the invention comprises feeding, with a random orientation, the glass support 1 towards the printing apparatus 200 on the conveyor surface 5, at a selectable speed V_sel and in the predefined direction Dir;

The invention comprises preparing a digital image I_dgt to be printed on the glass support 1.

To this end, the printing system of the invention comprises an insertion interface 300 (FIG. 1) configured to receive the digital image I_dgt to be printed on the glass support 1. The printing apparatus 200 comprises at least one printing support bar 201,202,203,204 which supports a plurality of print heads 201*i*,202*i*,203*i*,204*i*, configured to print the digital image I_dgt on the at least one glass support 1.

The invention further comprises locating the glass support 1 infed to the printing apparatus 200 on the conveyor surface 5, thereby determining location coordinates Xi",Yi",αi" of the glass support 1 relative to the first predefined reference Ref.

This step is implemented by means of the locating device 100.

The locating device and method were described previously.

In order to print an image correctly on the glass printing support, it is necessary to perform an alignment between the glass support and the image.

According to the prior art, the alignment can be achieved by acting on the glass support, moving it physically (e.g. by means of the guide).

According to the invention, the alignment is achieved by acting on the image and modifying it via software.

The technical effect achieved is to render the printing process independent of the position of the glass supports infed to the printing apparatus, for example in order to limit mechanical intervention and reduce the number of necessary parts.

If the glass supports were always correctly oriented, it would suffice to apply a transversal translation of the image relative to the printing bar, according to the position of the glass supports on the conveyor surface.

However, as the glass supports are not oriented correctly, it is necessary to know the angle of entry into the machine, which corresponds to the angle of rotation to be applied to the image.

The locating device previously described thus calculates this angle as well.

The invention enables the glass support 1 infed to the printing apparatus 200 to be located on the conveyor surface 5, thereby determining location coordinates Xi",Yi",αi" of the glass support 1 relative to the first predefined reference Ref.

Precisely, the coordinates Xi",Yi" represent the origin of the reference system of the theoretical contour of the glass support 1 relative to the first predefined reference Ref, whilst αi corresponds to the angle of rotation to be applied to the image.

The invention further envisages rotating the digital image I_dgt as a function of the positioning coordinates Xi",Yi", αi" of the glass support 1, thereby determining a rotated digital print image I_dgt_r_Print for the glass support 1.

To this end, the printing system of the invention comprises the processing unit 6, in data connection with the printing apparatus 200 and with the locating device 100.

The processing unit 6 comprises a rotation unit 67 configured to rotate the digital image I_dgt as a function of the positioning coordinates Xi",Yi",αi" of the glass support 1, thereby determining a rotated digital print image I_dgt_r_Print for the glass support 1; In order to rotate the digital image I_dgt, the invention comprises a computer-implemented rotation method.

The method of rotating a digital image I_dgt generates a print of a correspondent rotated print image I_dgt_r_print on at least one glass support 1.

Figure 9:
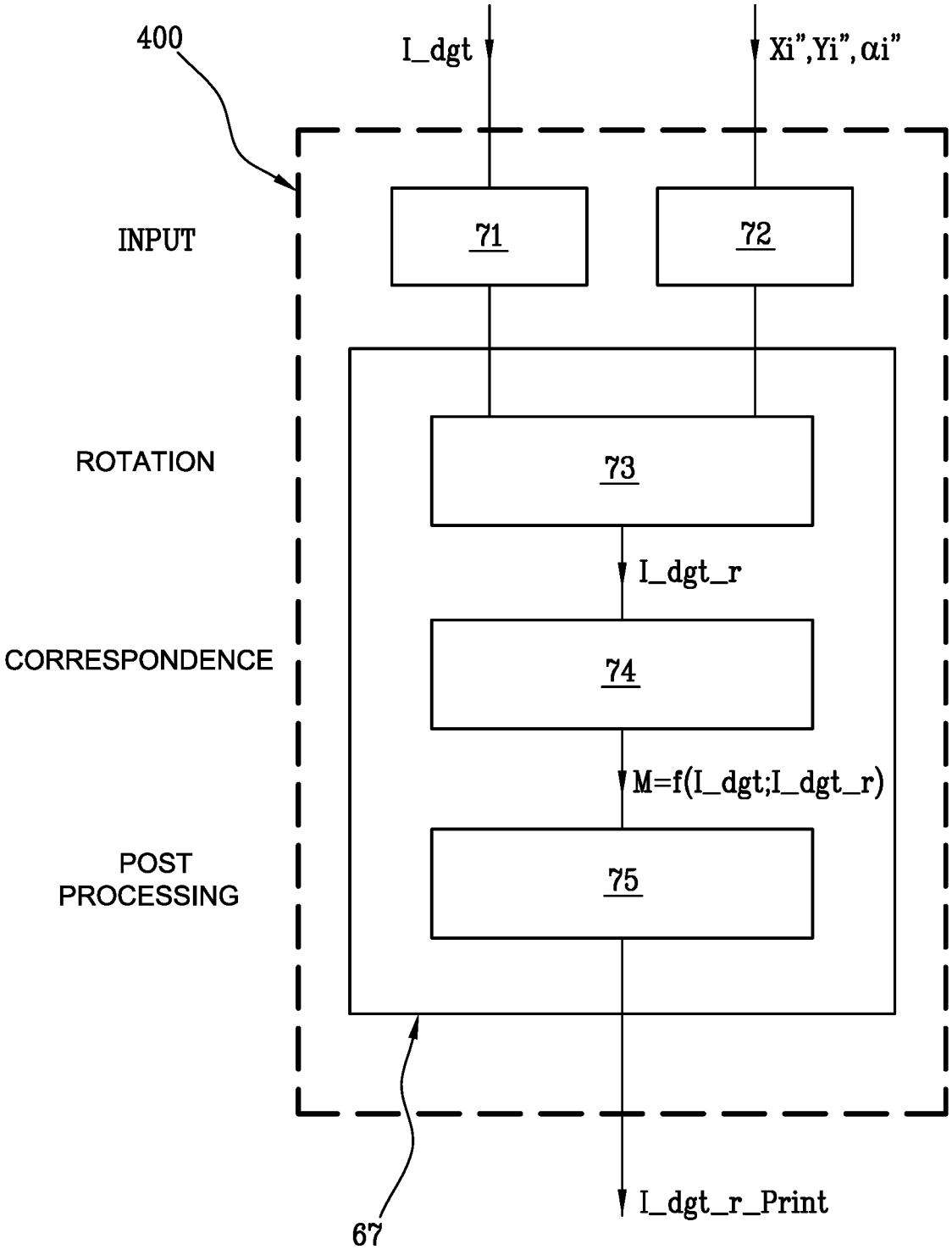
FIG. 9 is a block diagram of a device/method for rotating an image for a glass support.

With reference to FIGS. 9 and 2, the invention comprises a data input step which prepares the digital image I_dgt to be printed on the at least one glass support 1 and receives positioning coordinates Xi",Yi",αi" of the glass support 1 relative to a first predefined reference Ref.

For these purposes, with reference to FIG. 9, the processing unit 6 comprises a first receiving module 71 configured to receive a digital image I_dgt to be printed on the at least one glass support 1.

The processing unit 6 further comprises a second receiving module 72 configured to receive the positioning coordinates Xi",Yi",αi" of the glass support 1 relative to a first predefined reference Ref.

The invention envisages rotating the image I_dgt relative to its centre on the basis of the positioning coordinates Xi",Yi",αi", giving rise to a rotated image I_dgt_r.

In other words, the processing unit 6 comprises the rotation module 67 configured to digitally rotate the image I_dgt relative to its centre on the basis of the positioning coordinates Xi",Yi",αi", giving rise to a rotated image I_dgt_r.

According to the invention, the step of rotating the image I_dgt relative to its centre on the basis of the positioning coordinates Xi",Yi",αi", comprises the steps of:

applying a first translation T1 consisting in translating the image I_dgt in such a way that the centre of the image coincides with the origin of a reference rotation system;

rotating the image relative to its centre;

applying a second translation (T2) by translating the rotated image (I_dgt_r) in such a way that the pixel at the top right coincides with the origin of the reference rotation system.

In other words, the invention envisages rotating-translating the digital image of the glass support.

The rotation is performed by means of a technique of mapping between pixels Px_r_ij of the rotated image I_dgt_r and pixels Px_ij of the digital image I_dgt.

The invention comprises calculating a matrix of correspondences M between the pixels Px_r_ij of the rotated image I_dgt_r and the pixels Px_ij of the digital image I_dgt, wherein the matrix is configured to indicate how many pixels Px_r_ij of the rotated image I_dgt_r correspond to pixels Px_ij of the digital image I_dgt; in other words, M=f(I_dgt;I_dgt_r).

For this purpose, a first calculation module 74 is configured to calculate a matrix of correspondences M between the pixels Px_r_ij of the rotated image I_dgt_r and the pixels Px_ij of the digital image I_dgt, wherein the matrix is configured to indicate how many pixels Px_r_ij of the rotated image I_dgt_r correspond to pixels Px_ij of the digital image I_dgt.

There exist various mapping techniques in the literature, such as forward mapping and backward mapping.

In the former, however, it is possible that in the rotated image there may be so-called "holes" and "folds", i.e. pixels that have not been mapped and pixels that have been mapped several times, whose number, in the case of rotation, will depend on the angle.

For this reason, in general the transformations that use a forward mapping strategy are not objective.

In order to obtain an image formed by pixels mapped once and only once, it is necessary to use the reverse strategy, called backward mapping, that is, to associate a pixel of the original image with every pixel of the rotated image, which corresponds to applying a rotation of the same angle to the rotated image, but in the opposite direction. The problem is only partially resolved, however, since the approximation to be applied in backward mapping determines the presence of "holes" and "folds", this time in the original image.

In other words, some pixels of the original image are not mapped in pixels of the rotated image and consequently others are mapped more than once.

By analysing the distribution of correspondences, in particular with the calculated matrix of correspondences M, it has been seen that a pixel can be mapped twice at most and the maximum number of pixels mapped twice occurs with an angle of ±45°.

The incongruence with the original image due to the fact that there is not 1:1 mapping has repercussions on the rotated image, which proves to be of inferior quality compared to the original.

In the field of the invention, the depth of colour of the images is limited to 4 levels because only 2 bits are used for each channel (if not indeed images with only two levels, with one bit per pixel).

Interpolation between pixels that can take on only 4 (2) different values does not give good results, as it introduces graphically inacceptable artefacts.

There is also a variation in tone. In fact, in order to represent intermediate tones between the 4 levels used, one acts on the distribution of the points in the image. This distribution is performed by means of stochastic and error diffusion methods. When the image is rotated, it is necessary to preserve the stochastic distribution of the points in order not to alter the tone of the graphics.

In order to enhance the quality of the resulting image and the efficiency of the algorithm, it was thus decided to use the simplest method of interpolation, namely, the nearest neighbour method, which consists in approximating to the nearest pixels; this can be achieved by rounding the values of the coordinates.

Conventional mapping and interpolation thus do not give an optimal result in terms of image quality and efficiency of the rotation. A post-processing is thus necessary. According to the invention, and with reference to FIG. 10, the post-processing step comprises the steps of: detecting, from the matrix of correspondences M, the pixels of the digital image I_dgt that have no correspondence Px_33 with the pixels Px_r_ij of the rotated image I_dgt_r; detecting the pixels with multiple correspondences Px_r_32,Px_r_33 in the rotated image I_dgt_r;

remapping the pixels Px_33 with no correspondence in the digital image I_dgt in respective pixels with multiple correspondences Px_r_32,Px_r_33 in the rotated image I_dgt_r.

According to the invention, the remapping step determines the rotated digital print image I_dgt_r_Print having a preserved distribution of pixels relative to the digital image I_dgt.

In particular, the post-processing step can be implemented in the device 400 by means of a second calculation module 75.

The technical effect achieved is to preserve the stochastic distribution in which all the points have been included only once.

In other words, performing a post-processing by means of a matrix of correspondences M, containing, for every pixel of the original image, the coordinates of the pixels of the rotated image in which the original image was mapped, means returning to the source image by considering the pixels of the target image which correspond to pixels in the source image and taking into consideration, in the return to the source image, that use can be made of a nearest neighbour-type interpolation directed at the pixels near the pixel considered.

In other words, in order to enhance the quality of the resulting image and the efficiency of the algorithm, use has been made of the simplest interpolation method, namely, the nearest neighbour method, which consists in approximating to the nearest pixels; this can be achieved by rounding the values of the coordinates.

The technical effect achieved is to preserve the stochastic distribution in which all the points have been included only once.

Figure 10:
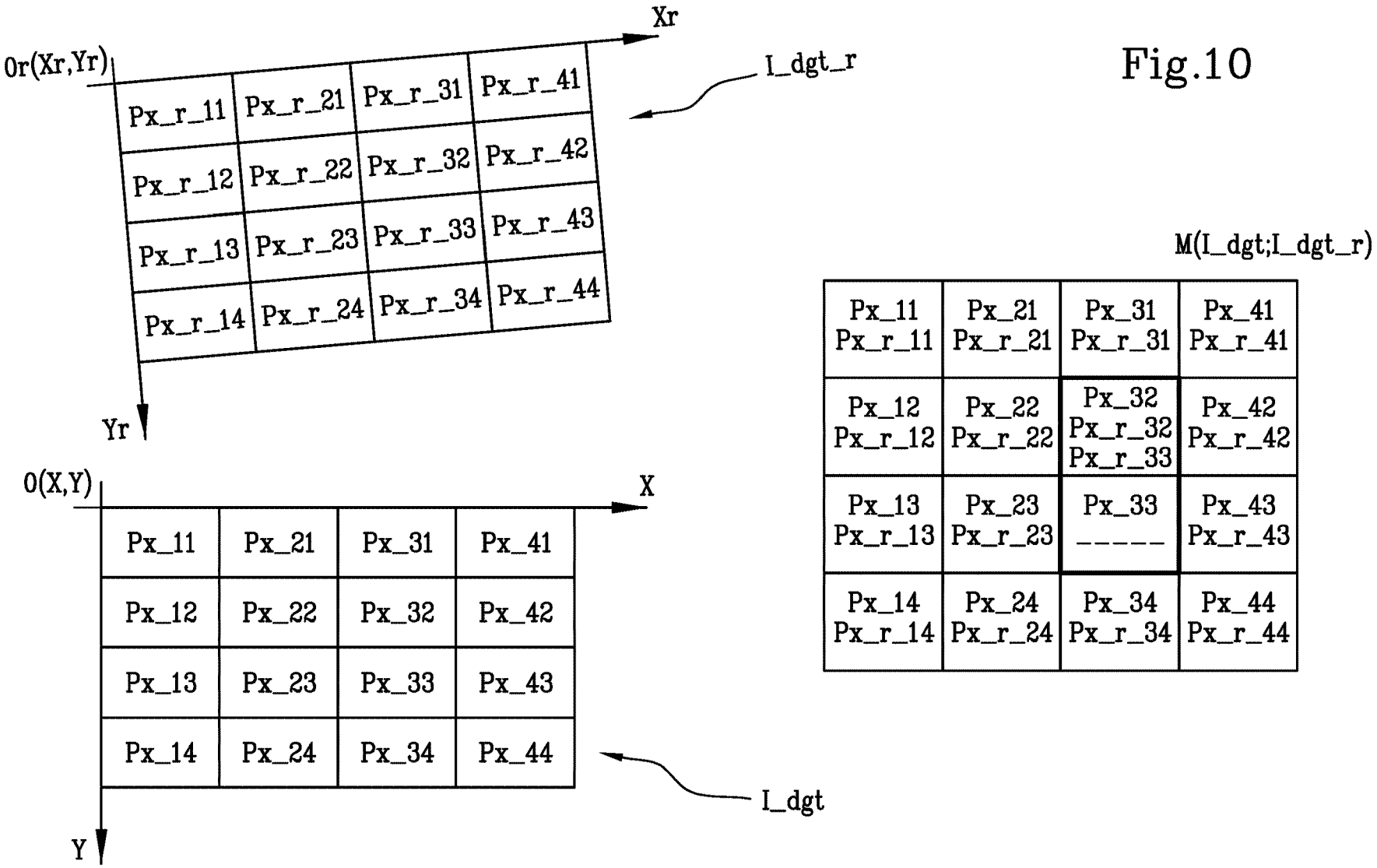
FIG. 10 describes details of the device/method of FIG. 9.

With reference to FIG. 10, according to the invention, the step of remapping the pixels Px_33 with no correspondence in the digital image I_dgt in respective pixels with multiple correspondences Px_r_32,Px_r_33 in the rotated image I_dgt_r comprises the steps of:

detecting, among the pixels near, for example the ones adjacent to the pixel with no correspondence Px_33 in the digital image I_dgt, whether there exists a pixel Px_32 that has a multiple correspondence with pixels Px_r_32 and Px_r_33 of the rotated image I_dgt_r;

and whether there exists a pixel Px_32 in the digital image I_dgt having a multiple correspondence with pixels Px_r_32 and Px_r_33 of the rotated image I_dgt_r, and copying, in one of the pixels Px_r_32 and Px_r_33 having a multiple correspondence, the identifier of the pixel Px_33 of the digital image I_dgt that has no correspondence with the pixel Px_r_ij of the rotated image I_dgt_r.

Advantageously, the step of copying, in one of the pixels Px_r_32 and Px_r_33 having a multiple correspondence, the identifier of the pixel Px_33 of the digital image I_dgt that has no correspondence with the pixel Px_r_ij of the rotated image I_dgt_r comprises the steps of:

if, in the original image, the pixel to be remapped (with zero correspondences) Px_33 is nearer to/farther from the origin O(X,Y) relative to the one mapped twice Px_32, copying, in the pixel Px_r_32 nearer to/Px_r_33 farther from the rotated origin or (Xr;Yr), the pixel Px_33 of the digital image I_dgt to be remapped.

The technical effect achieved by this last step is to preserve the right stochastic distribution of all the points in the rotated image.

In other words, the two coordinates found Px_r_32 and Px_r_33 correspond to two possible targets. The choice of one or the other is performed in such a way as to preserve the distribution of the pixels of the original image in the rotated one, based on the distance of the pixels from the origin of the image: if, in the original image, the pixel to be remapped (with zero correspondences), is nearer to/farther from the origin than the one mapped twice Px_32, the target pixel will be the one nearer to/farther from the rotated origin Preferably, the technique of mapping between pixels Px_r_ij of the rotated image I_dgt_r and pixels Px_ij of the digital image I_dgt is a backward mapping technique in which, starting from said rotated image I_dgt_r, one obtains said digital image I_dgt by rotating said rotated image I_dgt_r relative to the centre of the rotated image itself.

Preferably, the step of detecting, among the pixels near the pixel with no correspondence Px_33 in the digital image I_dgt, whether there exists a pixel Px_32 that has a multiple correspondence with pixels Px_r_32 and Px_r_33 of the rotated image I_dgt_r, is performed by means of a nearest neighbour technique.

As noted above, the post-processing step can be implemented in the device 400 by means of a second calculation module 75, as shown in FIG. 10.

The second calculation module 75 is configured, in the step of remapping the pixel Px_33 with no correspondence in the digital image I_dgt in respective pixels with multiple correspondences Px_r_32,Px_r_33 in the rotated image I_dgt_r, to:

detect, among the pixels near (for example the ones adjacent) to the pixels with no correspondence Px_33 in the digital image I_dgt), whether there exists a pixel Px_32 that has a multiple correspondence with the pixels Px_r_32 and Px_r_33 of the rotated image I_dgt_r;

and whether there exists a pixel Px_32 in the digital image I_dgt having a multiple correspondence with the pixels Px_r_32 and Px_r_33 of the rotated image I_dgt_r, and to copy, in one of the pixels Px_r_32 and Px_r_33 having a multiple correspondence, the identifier of the pixel Px_33 of the digital image I_dgt that has no correspondence with the pixel Px_r_ij of the rotated image I_dgt_r.

The second calculation module 75 is further configured, in the step of copying, in one of the pixels Px_r_32 and Px_r_33 having a multiple correspondence, the identifier of the pixel Px_33 of the digital image I_dgt that has no correspondence with the pixel Px_r_ij of the rotated image I_dgt_r, to perform the step of:

if, in the original image, the pixel to be remapped (with zero correspondences) Px_33 is nearer to/farther from the origin O(X,Y) relative to the one mapped twice Px_32, copying, in the pixel Px_r_32 nearer to/Px_r_33 farther from the rotated origin O(Xr;Yr), the pixel Px_33 of the digital image I_dgt to be remapped.

More in general, the calculation module 75 is configured to perform all the processing functions on the pixels described in reference to the post-processing step described in the method.

At the end of the step of rotating the image to be printed on the glass support 1, the image I_dgt_r_Print is ready to be printed with the right orientation on the glass support 1 infed to the printing apparatus 200.

In a preferred embodiment of the invention, the printing operation is performed by the plurality of print heads 201*i*,202*i*,203*i*,204*i* mounted on at least one printing support bar 201,202,203,204 in a predetermined and fixed position.

According to the invention, the plurality of print heads 201*i*,202*i*,203*i*,204*i* is configured for a printing on the glass support that entails a reduced ink thickness on the edges of the glass sheets to reduce embrittlement after tempering.

According to the invention, the plurality of print heads 201*i*,202*i*,203*i*,204*i* is configured for a printing on the glass support that entails printing with conductive inks based on conductive materials.

In one embodiment of the invention, the conveyor surface 5 of the conveyor roller type 51 is arranged so as to move a plurality of glass supports 1 along parallel rows.

In this embodiment, the plurality of print heads 201*i*,202*i*, 203*i*,204*i* is configured to print on the glass supports 1 in advancement without interruption on the aforesaid parallel rows.

In other words, as a moving glass support 1 arrives on the conveyor rollers, it is printed on by the print heads without waiting for the arrival of a subsequent support in transit along a parallel row.

In the preferred embodiment, the invention comprises printing on the glass support 1 the rotated print image I_dgt_r, maintaining the orientation of the glass support 1 unchanged relative to a second predefined reference Ref2.

In the preferred embodiment, the invention comprises printing the rotated-translated print image I_dgt_T_Print on the glass support 1, maintaining the orientation of the glass support 1 unchanged relative to a second predefined reference Ref2.

According to the invention, the second predefined reference Ref2 is the reference of the at least one printing support bar.

According to the invention, the printing on the glass support entails a reduced ink thickness on the edges of the glass sheets to reduce embrittlement after tempering. In practical terms, if the same amount of ink as used to reproduce the image to be printed in areas other than the edge is transferred onto the latter, during the tempering step fracture points may be created due to embrittlement on the edge of the glass itself.

According to the invention, printing on the glass support entails printing with conductive inks based on conductive materials.

The plurality of print heads 201*i*,202*i*,203*i*,204*i* is configured to print the digital image I_dgt_r_Print on the at least one glass support 1 moving at the selectable speed V_sel along the predefined direction Dir.

Summing up, the printing method/system of the invention thus enables the locating device 100 for locating the glass supports to "dialogue" with the printing apparatus 200. However, since the reference systems of the locating device 100 and of the printing apparatus 200 are different, it is important to "calibrate" the printing system in its entirety in order to make a coherent interaction between the aforesaid device and the aforesaid apparatus possible.

For this purpose, the processing unit 6 comprises a calibration module 68 associated with the locating module 65.

The calibration module 68 is configured to receive the location coordinates Xi",Yi",αi" and make them coherent with the second reference system Ref2.

The calibration is performed prior to the operation of rotating the image to be printed. Preferably, the calibration operation is performed at the start-up of the system configured to operate with a specific type of glass supports 1, i.e. with glass supports of a predefined size; upon a change in the dimensions of the glass supports to be conveyed, the system will require a new calibration.

The purpose of the calibration is therefore to align the first predefined reference Ref with the second predefined reference Ref2.

In a preferred embodiment of the invention, in the locating device 100, the first predefined reference Ref is the reference system of the second acquisition means 3, in particular of the camera.

In a preferred embodiment of the invention, in the printing apparatus 200, the second predefined reference Ref2 is the reference system of one of the printing support bars 201, 202,203,204.

In an alternative embodiment of the invention, in the printing apparatus 200, the second predefined reference Ref2 is the reference system of a plurality of printing support bars 201,202,203,204.

According to the invention, the aligning step comprises a first sub-step of feeding a glass support 1 with a random orientation on the conveyor surface 5 in the direction of movement Dir towards the printing apparatus 200, and the printing apparatus 200 printing a first pattern A on the glass support of printing 1 with the at least one printing support bar 201,202,203,204 in a fixed position in the second predefined reference Ref2, thus also maintaining the print heads 201*i*,202*i*,203*i*,204*i* in a fixed position.

In other words, once a glass support 1 has been fed towards the printing apparatus 200, the first sub-step enables a first pattern to be printed on the glass support 1.

Preferably, the printing step is preceded by detecting the reference system of the at least one printing support bar Ref2, According to the invention, the aligning step comprises a second sub-step of again feeding the glass printing support 1 on the conveyor surface 5 in the direction of movement Dir towards the apparatus 200, locating the first pattern A by means of the locating device 100 and printing a second pattern B on the glass support of printing 1.

In other words, after the glass support 1 has again been fed towards the printing apparatus 200, the second sub-step enables the first pattern A to be located and a second pattern B to be printed on the glass support.

According to the invention, the aligning step comprises a third sub-step of again feeding the glass support 1 on the conveyor surface 5 in said direction of movement Dir towards the apparatus 200 and locating the first pattern A and the second pattern B by means of the locating device 100.

In other words, the third sub-step enables the first pattern A and the second pattern B to be located.

According to the invention, the aligning step comprises a step of determining a matrix of rotation-translation between the two patterns A, B, thereby determining a matrix of rotation-translation between the first reference Ref and the second reference Ref2.

The technical effect achieved is that the alternation of sub-steps of printing known patterns and the subsequent acquisition/location thereof enables a 3×3 perspective transformation matrix (translation, rotation, scale, perspective) to be obtained between the location system (first predefined reference system Ref) and the single (or multiple) printing bar(s) (second predefined reference Ref2).

Another technical effect achieved is that, given that the "calibration" process is repeated for each printing bar (of a different colour), one obtains the calibration of each bar with the location system and, because of the transitive property, each print head is calibrated with the others.

This effect makes it possible to avoid mechanically aligning the print heads in a micrometric manner.

The effect of this approach is that any mechanical misalignment will be compensated for by the electronic calibration.

Going into greater detail, the calibration module receives, as input, a series of images of the glass support of printing 1 acquired/located by the locating device and outputs a table of calibration values that are saved in the product database.

In the preferred embodiment of the invention, we can consider that in the system for digital printing on glass supports, three reference systems are present:

first reference system (Ref) of the second acquisition means 3 (x",y"), in particular a camera;

second reference system (Ref2) of the at least one printing support bar (x,y);

third reference system of the glass support (x',y').

Figure 6:
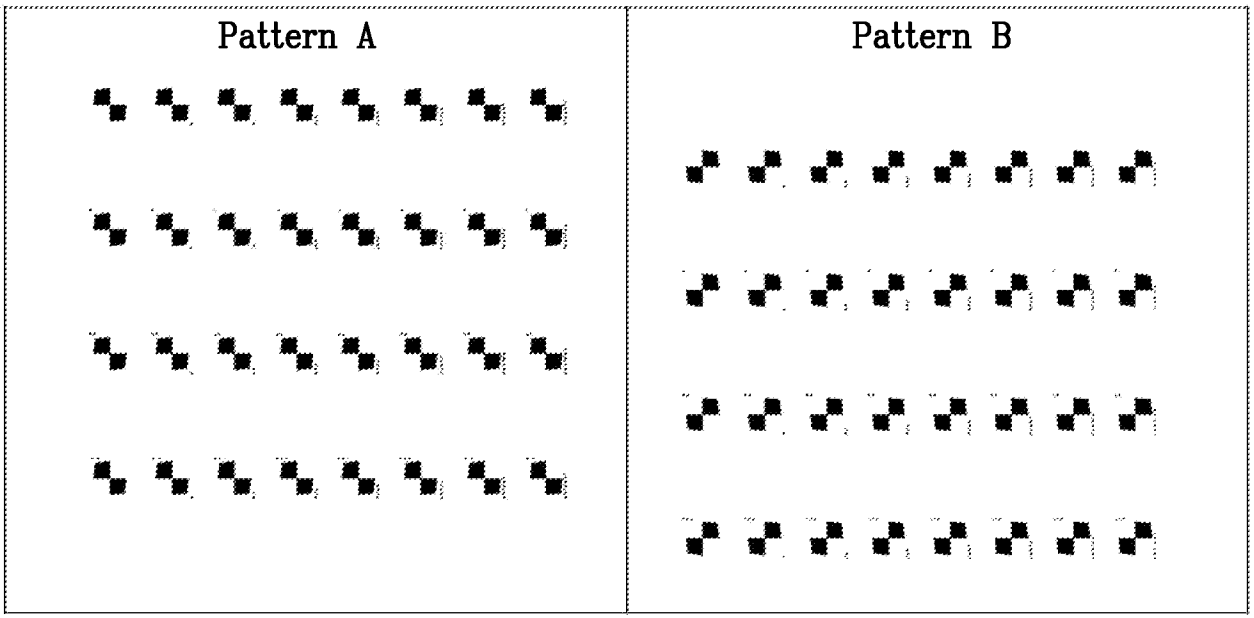
FIG. 6 is a logic diagram of a detail of the step of the method of the invention shown in FIG. 5.
Figure 7:
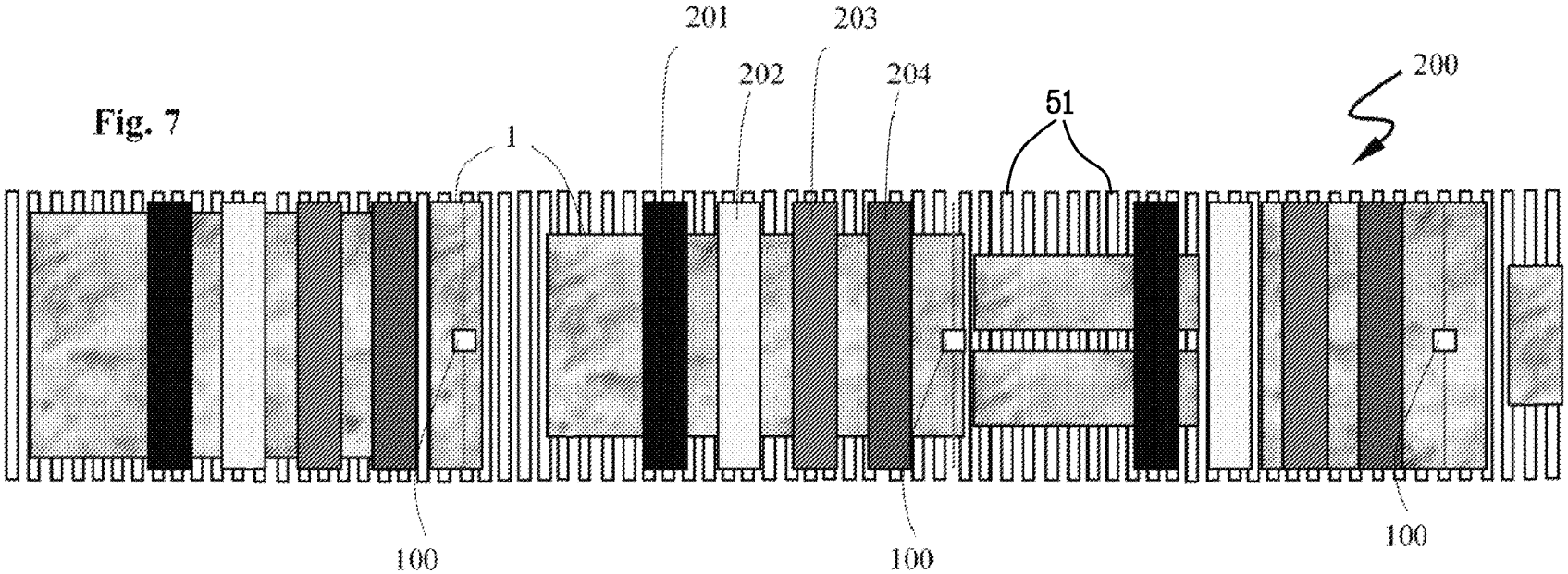
FIG. 7 is a schematic top view of a printing system of the invention, comprising a plurality of printing stations, and positioned downstream of the locating device of FIG. 1.
Figure 8:
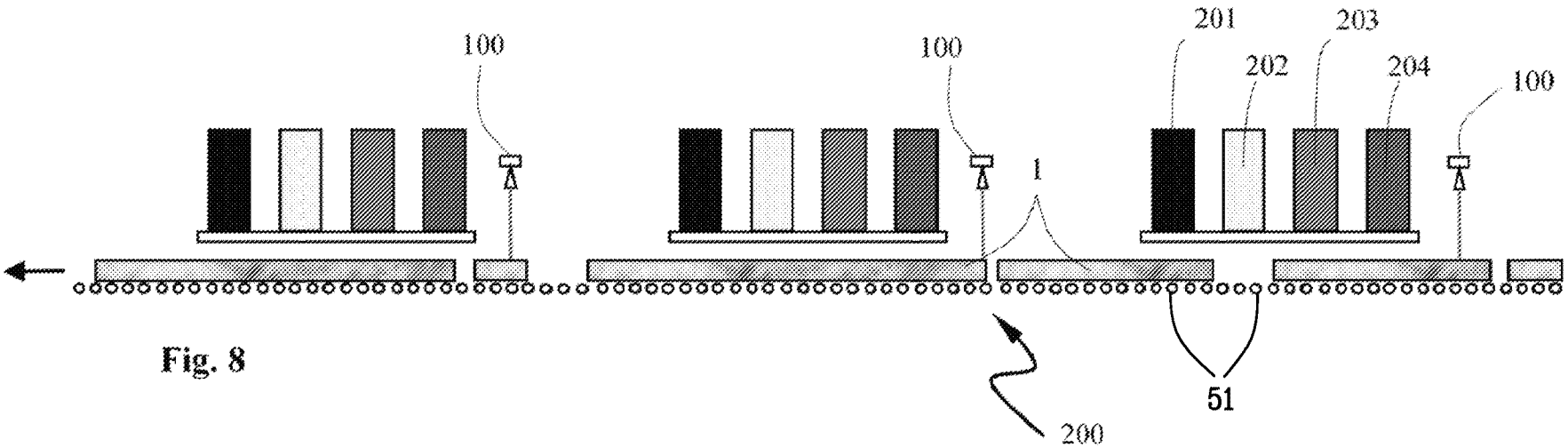
FIG. 8 is a schematic side view of the printing system of FIG. 7.

With reference to FIG. 6, for a correct calibration of the system, the two patterns indicated by the letters A and B are used. The patterns have the appearance of a matrix of markers easily locatable by the vision software. Each marker is characterised by a direction and a row and column number that serves to identify it.

The patterns are generated according to the size and resolution of the printing apparatus: in width they contain a number of points equal to the number of nozzles. They are in fact integral with the reference system of the printing support bar.

The calibration process will now be described in detail.

1. In the first step of the calibration process, in order to align different reference systems (for example the first predefined reference Ref and the second predefined reference Ref2) the pattern A is printed on a glass printing support.

It is assumed that the glass printing support has entered the system in a random position and that the print heads remain on a fixed reference system:

(x1', y1') printing support reference system at the first step;

(x, y) printing bar reference system;

2. In the second step, the printing support is fed back in and scanned by the camera, processed by the calibration software module and a position and number are obtained for every marker.

Furthermore, maintaining the position, it is printed with the pattern B. Let us consider:

(x2', y2')≠(x1', y1') printing support reference system at step 2

(x", y") camera reference system (x, y) printing bar reference system

3. In the third step the printing support is fed back in and scanned a second time. It is processed by the calibration software module, and a position and identification number are obtained for every marker, repeating the operation for the markers of both pattern A and pattern B. The two patterns are easily distinguishable, as they are asymmetrical.

Let us consider:

(x3', y3')≠(x2', y2')≠(x1', y1') printing support reference system at step 3;

(x", y") camera reference system;

Considering, for the sake of simplicity, a single marker of the pattern B, let us consider:

Pb position of marker B in the printing bar reference system (x,y) (known a priori);

Pb3" position of marker B in the camera reference system (x", y") (derived by the analysis software) at step 3.

Having moved the printing support between steps 2 and 3, the correct relation is given by Pb=F(Pb3")+G((x3', y3')−(x2', y2')) where the second addend considers the variation the printing support reference system has undergone between step 3 and step 2.

In other words, the second addend represents the transformation coefficient for bringing the printing support reference system of step 3 to step 2.

In order to evaluate this second transfer function, let us consider the same marker of pattern A at step 2 and at step 3.

Given that the camera reference system has not changed, we can consider:

P2" position of marker A in the camera reference system (x", y") at step 2.

P2' position of marker A in the printing support reference system (x2', y2') at step 2.

P3" position of marker A in the camera reference system (x", y") at step 3.

P1' position of marker A in the printing support reference system (x3', y3') at step 3.

Given that the position of the marker in the camera reference system has not changed between step 2 and step 3, we can affirm that: P2'=G2 (P2")=P3'=G3 (P3") P3"=G3G2 (P2")

This function represents the point variation taking place between step 2 and step 3.

The final formula can thus be summed up with: P=F (P3")+G(P2") By applying this formula to all the positions P of the markers and ordering them, we obtain a relation: [P . . . Pn]=M [P" . . . Pn"]

From which, through the solution of the problem, we obtain a matrix M of dimensions [3×3] containing the coefficients of the linear transformation from the camera reference system to the bar reference system.

In conclusion, the invention enables a precise location of a glass support and a consequent precise and reliable processing of the data related to the glass support.

The provision, according to the invention, of a precise location of glass supports, i.e. a precise identification of the positioning of the glass supports on the infeed side of a system, enables an optimization of the subsequent control and printing steps, thus ensuring a more efficient and flexible printing system/method.

The invention, as described, achieves the following additional technical effects, as compared to the prior art:

- less risk of damaging the glass supports due to the lack of any need to rotate them mechanically in order to correct their orientation;
- lack of any need to have incoming glass oriented in an optimal manner, which makes it possible to considerably reduce the time of preparing the printing substrates and printing times;
- separability of the stations making up the system, which ensures the possibility of having several stations of the system work in parallel or remotely, with the following advantages:
  - production efficiency, by virtue of the fact that production times are no longer dependent on the sum of the times of stations arranged in series in the system and separable neither physically, nor in terms of sequential timing;
  - more efficient maintenance, by virtue of the fact that one station can undergo inspection without blocking the others;
  - a better reaction to malfunctions, by virtue of the fact that a malfunction in one station will not block the entire system, as the station can be momentarily replaced by another similar one.

The invention claimed is:

1. A device for locating a glass support when said glass support is moving on a conveyor roller surface in a feed direction at a selectable speed, the device comprising:

i) illumination means for said glass support configured to illuminate said glass support in movement on conveyor rollers;

ii) acquisition means configured to acquire a plurality of lines of said glass support in movement as a function of a line frequency, the line frequency being defined as a function of an acquisition rate, said acquisition means being configured to acquire said plurality of rows; and iii) a processing unit, in data connection with said acquisition means, comprising:

a) a receiver module configured to receive said plurality of lines acquired by said acquisition means;

b) a generation module configured to generate a primary image as a function of an acquired plurality of lines;

c) a detection module configured to detect from said primary image a plurality of representative points of said glass support, wherein the coordinates of said plurality of points are expressed in relation to a first reference;

d) a locating module configured to receive, as input, said plurality of representative points and calculate location coordinates of said glass support relative to said first reference as a function of said plurality of representative points; and e) a loading module configured to load a graphic file describing a theoretical contour of said glass support in movement on said conveyor surface, wherein said plurality of points are representative of an actual contour of said glass support, and said locating module is configured to calculate said location coordinates of said glass support relative to said first reference as a function of said plurality of representative points, said calculation following a fitting algorithm between said actual contour of said glass support, determined by said plurality of points, and said theoretical contour of said glass support.

2. The device according to claim 1, wherein in said locating module, said fitting algorithm comprises the steps of:

applying a rotation-translation of a set amount to said theoretical contour to obtain a rotated-translated theoretical contour;

calculating an average distance between said actual contour and said rotated-translated theoretical contour to obtain a calculated distance function;

searching for a minimum point of the calculated distance function;

disturbing the rotation-translation by a certain amount;

recalculating the average distance in an iterative way; and stopping when a difference between calculated minimum distances is less than a reference value.

3. The device according to claim 1, wherein said graphic file describes a plurality of theoretical contours of different said glass supports adapted to move on said conveyor surface.

4. The device according to claim 3, wherein said locating module is configured to calculate said location coordinates of said glass support relative to said first reference as a function of said plurality of representative points by means of a fitting algorithm between said actual contour of said glass support, determined by said plurality of points, and each theoretical contour of said plurality of theoretical contours of said different glass supports adapted to move on said conveyor surface.

5. The device according to claim 4, wherein in said locating module, said fitting algorithm comprises, for each said theoretical contour of said plurality of theoretical contours of different said glass supports, the steps of:

applying a rotation-translation of a set amount to said theoretical contour to obtain a rotated-translated theoretical contour;

calculating an average distance between said actual contour and said rotated-translated theoretical contour to obtain a calculated distance function;

searching for a minimum point of the calculated distance function;

disturbing the rotation-translation by a certain amount;

recalculating the average distance in an iterative way;

stopping when a difference between calculated minimum distances is less than a reference value;

calculating a minimum among average distances between said actual contour and said rotated-translated theoretical contour, calculated for each said theoretical contour of said plurality of theoretical contours of different said glass supports; and identifying said location coordinates of said glass support on the basis of an identified theoretical contour of said plurality of theoretical contours.

6. The device according to claim 1, wherein said illumination means and said acquisition means are positioned on a same side relative to the conveyor surface.

7. The device according to claim 1, wherein said illumination means are configured to emit a light beam incident on the conveyor surface according to an angle of incidence, the light beam so generated appearing as a linear stripe, orthogonal to the feed direction.

8. The device according to claim 7, wherein said angle of incidence has a first width to ensure a sufficient reflection of said glass support illuminated by said illumination means.

9. The device according to claim 8, wherein said angle of incidence has a second width comprised between 87° and 93°, substantially coincident with 90° in an optimal solution.

10. The device according to claim 1, wherein the locating module is configured to acquire a plurality of lines of said glass support from different acquisition points substantially transversely relative to said feed direction.

11. The device according to claim 10, wherein said locating module is configured to detect a plurality of glass supports in movement on said conveyor roller surface when said glass supports are moving in parallel rows on a single conveyor surface.

12. The device according to claim 11, comprising a plurality of acquisition means arranged to detect said glass supports in movement in parallel rows.

13. A system for digital printing on glass supports, comprising:

an insertion interface configured to receive a digital image to be printed on at least one glass support;

a conveyor roller surface configured to convey said at least one glass support with a random orientation towards a printing apparatus at a selectable speed and in a feed direction, said printing apparatus comprising at least one printing support bar which supports a plurality of print heads, configured to print said digital image on said at least one glass support;

the locating device of claim 1, positioned on an infeed side of said printing apparatus, and configured to locate said at least one glass support moving with a random orientation on said conveyor roller surface, thereby determining location coordinates of said glass support relative to a first reference; and a processing unit, in data connection with said printing apparatus and with said locating device, said processing unit comprising a rotation module configured to rotate-translate said digital image as a function of said positioning coordinates of said glass support, thereby determining a rotated-translated digital print image for said glass support, wherein said plurality of print heads are configured to print said digital image on said at least one glass support, maintaining the orientation of said glass support unchanged relative to a second reference.

14. The system according to claim 13, wherein:

said conveyor roller surface is arranged so as to move a plurality of glass supports along parallel rows; and said plurality of print heads is configured to print on said glass supports in advancement without interruption on said parallel rows.

* * * * *